US012281535B2

(12) United States Patent
Wang et al.

(10) Patent No.: US 12,281,535 B2
(45) Date of Patent: Apr. 22, 2025

(54) UNDERWATER-WELLHEAD FEEDING TOOL ASSEMBLY AND USE METHOD THEREOF

(71) Applicant: CHINA UNIVERSITY OF PETROLEUM-BEIJING, Beijing (CN)

(72) Inventors: Yanbin Wang, Beijing (CN); Jinduo Wang, Beijing (CN); Deli Gao, Beijing (CN); Shilin Xin, Beijing (CN)

(73) Assignee: CHINA UNIVERSITY OF PETROLEUM-BEIJING, Beijing (CN)

( * ) Notice: Subject to any disclaimer, the term of this patent is extended or adjusted under 35 U.S.C. 154(b) by 7 days.

(21) Appl. No.: 18/403,168

(22) Filed: Jan. 3, 2024

(65) Prior Publication Data

US 2024/0254850 A1 Aug. 1, 2024

(30) Foreign Application Priority Data

Jan. 30, 2023 (CN) ..... 202310118692.9

(51) Int. Cl.
*E21B 33/04* (2006.01)
*E21B 23/02* (2006.01)
(Continued)

(52) U.S. Cl.
CPC ..... *E21B 33/0355* (2013.01)

(58) Field of Classification Search
None
See application file for complete search history.

(56) References Cited

U.S. PATENT DOCUMENTS 5,327,972 A * 7/1994 Theiss ..... E21B 33/04 166/208
5,655,606 A * 8/1997 Ferguson ..... E21B 33/043 166/85.1
(Continued)

FOREIGN PATENT DOCUMENTS

CN 102834583 A 12/2012
CN 105888649 A 8/2016
(Continued)

OTHER PUBLICATIONS

Notification of Grant issued in related Chinese Application No. 202310118692.9, on Aug. 29, 2023, in 5 pages.
(Continued)

*Primary Examiner* — Matthew R Buck
*Assistant Examiner* — Douglas S Wood
(74) *Attorney, Agent, or Firm* — Davis Wright Tremaine LLP

(57) ABSTRACT

The present application provides an underwater-wellhead feeding tool assembly and a use method thereof. The device controls a controller to add pressure to an inside of a drive cylinder through a first pipeline via a first port, and to add pressure to a cavity apace between a pressure-bearing cylinder and the drive cylinder through a first branch line; the controller controls, through a third branch line, the drive device to transmit a torque to the underwater wellhead feeding tool, and transmit, through a second branch line, an axial force to the underwater wellhead feeding tool; and then a sensing component transmits a detected stress signal and/or strain signal to a data acquisition device through a test lead, thereby testing and analyzing an effect of different force field conditions on mechanical behaviors and performance of the underwater wellhead feeding tool.

13 Claims, 2 Drawing Sheets

(51) Int. Cl.
*E21B 33/035* (2006.01)
*E21B 43/10* (2006.01)

(56) References Cited

U.S. PATENT DOCUMENTS

| | | | | |
|---|---|---|---|---|
| 6,302,211 | B1 * | 10/2001 | Nelson | E21B 33/043 166/348 |
| 2001/0054507 | A1 * | 12/2001 | Bartlett | E21B 33/064 166/88.4 |
| 2009/0194293 | A1 * | 8/2009 | Stephenson | E21B 43/122 166/372 |
| 2012/0037382 | A1 * | 2/2012 | Eppinghaus | E21B 33/04 166/123 |
| 2018/0100364 | A1 * | 4/2018 | Nguyen | E21B 23/01 |
| 2018/0153496 | A1 * | 6/2018 | Sasaki | A61B 6/542 |

FOREIGN PATENT DOCUMENTS

| | | | |
|---|---|---|---|
| CN | 206235459 | U | 6/2017 |
| CN | 107387026 | A | 11/2017 |
| CN | 107420064 | A | 12/2017 |
| CN | 208220699 | U | 12/2018 |
| CN | 114459785 | A | 5/2022 |

OTHER PUBLICATIONS

Chinese Office Action issued in related Chinese Application No. 202310118692.9, on Jun. 27, 2023, in 7 pages.

* cited by examiner

UNDERWATER-WELLHEAD FEEDING TOOL ASSEMBLY AND USE METHOD THEREOF

CROSS-REFERENCE TO RELATED APPLICATIONS

This application claims priority to Chinese Patent Application No. 2023101186929, filed on Jan. 30, 2023, which is hereby incorporated by reference in its entirety.

TECHNICAL FIELD

The present application relates to the technical field of auxiliary equipment for oil exploitation and, in particular, to an underwater-wellhead feeding tool assembly and a use method thereof.

BACKGROUND

For so long now, oil and gas resources have played an important role in the energy structure. With the transformation of the energy structure, the exploitation of oil and gas in deep-sea waters will become a strategic choice and main direction for the development for Chinese petroleum.

The drilling work on oil and gas wells in deep-sea waters usually faces complex oceanic deep-water environments and difficult operating conditions. Therefore, the establishment of safe and stable underwater wellheads under deep sea will help to ensure the stability of deep-water drilling operation. Underwater-wellhead feeding tool under water as a tool for guaranteeing the installing of underwater wellheads under deep sea is particularly important. However, at present, there is no means for evaluating the reliability of underwater-wellhead feeding tools, for example, there is no means for evaluating mechanical properties including yield strength of underwater-wellhead feeding tools. It is urgent to conduct research on mechanical-behavior testing and testing methods of underwater-wellhead feeding tools, so as to more effectively guide the installation work of underwater wellheads at high pressure in deep waters, and further improve work efficiency and stability.

SUMMARY

In view of the lack of means for evaluating the reliability of underwater-wellhead feeding tools mentioned above, the present application provides an underwater-wellhead feeding tool assembly and a use method thereof, so as to test and analyze the effect of different force field conditions on mechanical behaviors and performance of an underwater-wellhead feeding tool, and to achieve the verification of structural strength of the feeding tool. The underwater-wellhead feeding tool is mainly used for auxiliary work for high-pressure underwater wellheads in deep waters, which provides scientific principle guidance for efficient and stable installation of drilling and oil-gas production equipment at underwater wellheads at high pressure in deep waters.

In order to achieve the above objectives, the present application provides the following technical solutions.

A first aspect of the present application provides an underwater-wellhead feeding tool assembly, including a fix component, a drive system, and a transmission system. The fix component includes a pressure-bearing cylinder, and a drive cylinder and an underwater-wellhead feeding tool that are disposed within the pressure-bearing cylinder. A transmission mechanism is connected between the drive cylinder and the underwater-wellhead feeding tool; a side wall of the pressure-bearing cylinder is provided with a first port and a second port, and a bottom of the pressure-bearing cylinder is provided with a third port.

The drive system includes a controller, a drive device, a first pipeline, and a second pipeline. The drive device is connected to the underwater-wellhead feeding tool; one end of the first pipeline and one end of the second pipeline are in signal connection with the controller, respectively. The other end of the first pipeline is connected to the first port, and the other end of the second pipeline includes a first branch line, a second branch line, and a third branch line; the first branch line is connected to the second port, the second branch line is connected to the underwater-wellhead feeding tool, and the third branch line is connected to the drive device.

The transmission system includes a sensing component, a test lead, and a data acquisition device. The sensing component is provided inside the drive cylinder; one end of the test lead is connected to the sensing component and the other end of the test lead passes through the third port and is connected to the data acquisition device.

The controller adds pressure to an inside of the drive cylinder through the first pipeline via the first port, and adds pressure to a cavity space between the pressure-bearing cylinder and the drive cylinder through the first branch line, so as to simulate an underwater pressure environment for an underwater-wellhead feeding tool. The controller controls, through the third branch line, the drive device to transmit a torque to the underwater-wellhead feeding tool, and transmits, through the second branch line, an axial force to the underwater-wellhead feeding tool, so as to simulate a force bearing situation of the underwater-wellhead feeding tool in a process of connecting the underwater-wellhead feeding tool to an underwater wellhead, and locking the underwater-wellhead feeding tool to the underwater wellhead by a linear movement of the underwater-wellhead feeding tool relative to the drive cylinder by means of the transmission mechanism; and then the sensing component transmits a detected stress signal and/or strain signal to the data acquisition device through the test lead.

The present application has at least the following beneficial effects of achieving a simulation of a force field of an environment where an underwater-wellhead feeding tool performs underwater work by means of a controller controlling a plurality of pipelines to apply an axial force and/or a torque to the underwater-wellhead feeding tool in the pressure-cylinder, and testing the mechanical behavior and deformation law of the underwater-wellhead feeding tool affected by the force field during an installation process of an underwater wellhead, thereby providing theoretical guidance and basis for efficient and stable installation of underwater wellheads for oil and gas exploitation.

In the underwater-wellhead feeding tool assembly mentioned above, in a possible implementation, the underwater-wellhead feeding tool assembly further includes an elastic member provided within the pressure-bearing cylinder, the elastic member is connected to the underwater-wellhead feeding tool through the drive cylinder; and the elastic member is a spring.

In the underwater-wellhead feeding tool assembly mentioned above, in a possible implementation, the sensing component is a stress sensor and/or strain sensor, and one side or two sides of an inner wall of the drive cylinder is provided with the stress sensor and/or strain sensor.

In the underwater-wellhead feeding tool assembly mentioned above, in a possible implementation, a plurality of stress sensors and/or strain sensors are provided, one end of the test lead has a plurality of branch lines, and the plurality of branch lines are in one-to-one connection with the plurality of stress sensors and/or strain sensors; each stress sensor and/or strain sensor is a fiber optic grating sensor.

In the underwater-wellhead feeding tool assembly mentioned above, in a possible implementation, the transmission mechanism is a connection rod; the controller is a hydraulic power control system; the drive device is a servo motor; and the data acquisition system is a fiber optic stress-strain meter.

A second aspect of the present application provides a use method of the underwater-wellhead feeding tool assembly according to any one of the above technical solutions, including the following steps:

adding, by the controller, pressure to an inside of the drive cylinder and to a cavity space between the pressure-bearing cylinder and the drive cylinder, so as to simulate a pressure environment for the underwater-wellhead feeding tool to perform underwater operation;

applying an axial force and/or a torque to the underwater-wellhead feeding tool, so as to simulate a force bearing situation of the underwater-wellhead feeding tool in a process of feeding and installing an underwater wellhead;

collecting a mechanical parameter of a first part, the first part includes the underwater-wellhead feeding tool; the mechanical parameter is a stress value and/or strain value;

performing parameter processing on the mechanical parameter, the strain value is converted into the stress value according to Generalized Hooke's Law;

performing strength verification on the underwater-wellhead feeding tool according to the stress value, based on Fourth Strength Theory.

In the above use method, in a possible implementation, a connection rod is connected between the underwater-wellhead feeding tool and the drive cylinder, and the underwater-wellhead feeding tool includes a core shaft and a joint sleeved at an outside of the core shaft;

the first part is one or more of the core shaft, the joint, the connection rod, and the drive cylinder.

In the above use method, in a possible implementation, the use method involves performing a separate test or a combination test on the first part; the separate test involves applying the axial force or the torque to the first part separately for testing; and the combination test involves applying the axial force and the torque to the first part for testing.

In the above use method, in a possible implementation, combination forms of the combination test include: applying a constant axial force and a variable torque to the underwater-wellhead feeding tool, or applying a constant torque and a variable axial force to the underwater-wellhead feeding tool, or applying a variable axial force and a variable torque to the underwater-wellhead feeding tool.

In the above use method, in a possible implementation, the strength verification includes the following steps:

calculating an axial stress, a radial stress, and a circumferential stress, to which the underwater wellhead feeding tool is subjected, the underwater wellhead feeding tool is in the shape of a pipe;

calculating a Mises stress based on the axial stress, the radial stress, and the circumferential stress;

comparing the Mises stress with a yield strength of a material of the underwater-wellhead feeding tool.

A calculation formula for the axial stress is:

$$\sigma_a = \frac{F}{A_o - A_i}; \quad \text{(Formula 1)}$$

in Formula 1, F is an axial force applied for testing, $A_o$ is a cross-sectional area of an outer circumference of the underwater-wellhead feeding tool, $A_i$ is a cross-sectional area of an inner circumference of the underwater-wellhead feeding tool.

A calculation formula for the radial stress is:

$$\sigma_r = \frac{p_i R_i^2 - p_o R_o^2}{R_o^2 - R_i^2} - \frac{(p_i - p_o) R_i^2 R_o^2}{R_o^2 - R_i^2} \frac{1}{r^2}; \quad \text{(Formula 2)}$$

a calculation formula for the circumferential stress is:

$$\sigma_\theta = \frac{p_i R_i^2 - p_o R_o^2}{R_o^2 - R_i^2} + \frac{(p_i - p_o) R_i^2 R_o^2}{R_o^2 - R_i^2} \frac{1}{r^2}; \quad \text{(Formula 3)}$$

in Formulas 2 and 3, $R_i$ is an inner radius of the underwater-wellhead feeding tool, $R_o$ is an outer radius of the underwater-wellhead feeding tool, r is a distance from a center point of a cross-section of the underwater-wellhead feeding tool in a direction perpendicular to a length direction of the pipe to a center point between an inner wall of the pipe and an outer wall of the pipe, $p_i$ is an internal pressure subjected by the underwater-wellhead feeding tool, i.e., an internal pressure of the drive cylinder 5, $p_o$ is an external pressure subjected by the underwater wellhead feeding tool, i.e., a pressure of a cavity space between the pressure-bearing cylinder and the drive cylinder.

A calculation formula for the Mises stress is:

$$\sigma_{\theta\varphi} = \sqrt{\sigma_r^2 + \sigma_\theta^2 + \sigma_a^2 - \sigma_r\sigma_\theta - \sigma_r\sigma_a - \sigma_\theta\sigma_a}. \quad \text{(Formula 4)}$$

The beneficial effects provided by the second aspect of the present application include the beneficial effects provided by the first aspect of the present application, which will not be repeated here.

BRIEF DESCRIPTION OF DRAWINGS

In order to describe the technical solutions in embodiments of the present application or in the prior art more clearly, the following briefly introduces the accompanying drawings needed for describing the embodiments or the prior art. Apparently, the accompanying drawings in the following description illustrate merely some embodiments of the present application, and persons of ordinary skill in the art may still derive other accompanying drawings from these accompanying drawings without creative effort.

REFERENCE NUMBER

1—Servo motor; 2—Underwater-wellhead feeding tool; 3—Connection rod; 4—Stress sensor; 5—Drive cylinder;

6—Spring; 7—Pressure-bearing cylinder; 8—First pipeline; 9—Test lead; 10—First port; 11—Third port; 12—Data acquisition device; 13—Hydraulic power control system; 14—Second port; 15—Second pipeline.

DESCRIPTION OF EMBODIMENTS

As described in the background, the exploitation of oil and gas in deep-sea waters has gradually become a key development direction in the petrochemical industry. In related technologies, the stability of feeding operation of underwater wellheads is insufficient and the exploitation efficiency is low. After research by the inventors, it was found that as the depth at which underwater drilling operation is performed increases, the environment becomes increasingly harsh. For example, a high-pressure environment in the deep sea has a negative impact of providing a complex force field on an underwater-wellhead feeding tool, thereby affecting the stability of the process of getting into the water and installation of the underwater-wellhead feeding tool equipped with a high-pressure underwater wellhead. However, there are insufficient means for evaluating the reliability of underwater-wellhead feeding tools, and the needs of pre-evaluating the working stability of underwater-wellhead feeding tools and evaluating and analyzing the performance of tools after underwater wellheads are installed cannot be met.

In view of the above technical problems, an embodiment of the present application provides an underwater-wellhead feeing tool assembly. By means of controlling, by a controller, a plurality of pipelines to apply an axial force and/or a torque to an underwater-wellhead feeding tool in a pressure-bearing cylinder, a simulation of a force field of an underwater working environment for the underwater-wellhead feeding tool can be achieved, and a mechanical behavior and deformation law of the underwater-wellhead feeding tool affected by the force field during an installation process of an underwater wellhead can be tested, thereby providing theoretical guidance and basis for efficient and stable installation of underwater wellheads for oil and gas exploitation.

To make the above objectives, features, and advantages of embodiments of the present application clearer, the following clearly and comprehensively describes the technical solutions in embodiments of the present application in combination with the accompanying drawings. Apparently, the described embodiments are merely a part rather than all embodiments of the present application. All other embodiments obtained by persons of ordinary skill in the art based on embodiments of the present application without creative effort shall fall within the protection scope of the present application.

Figure 2:
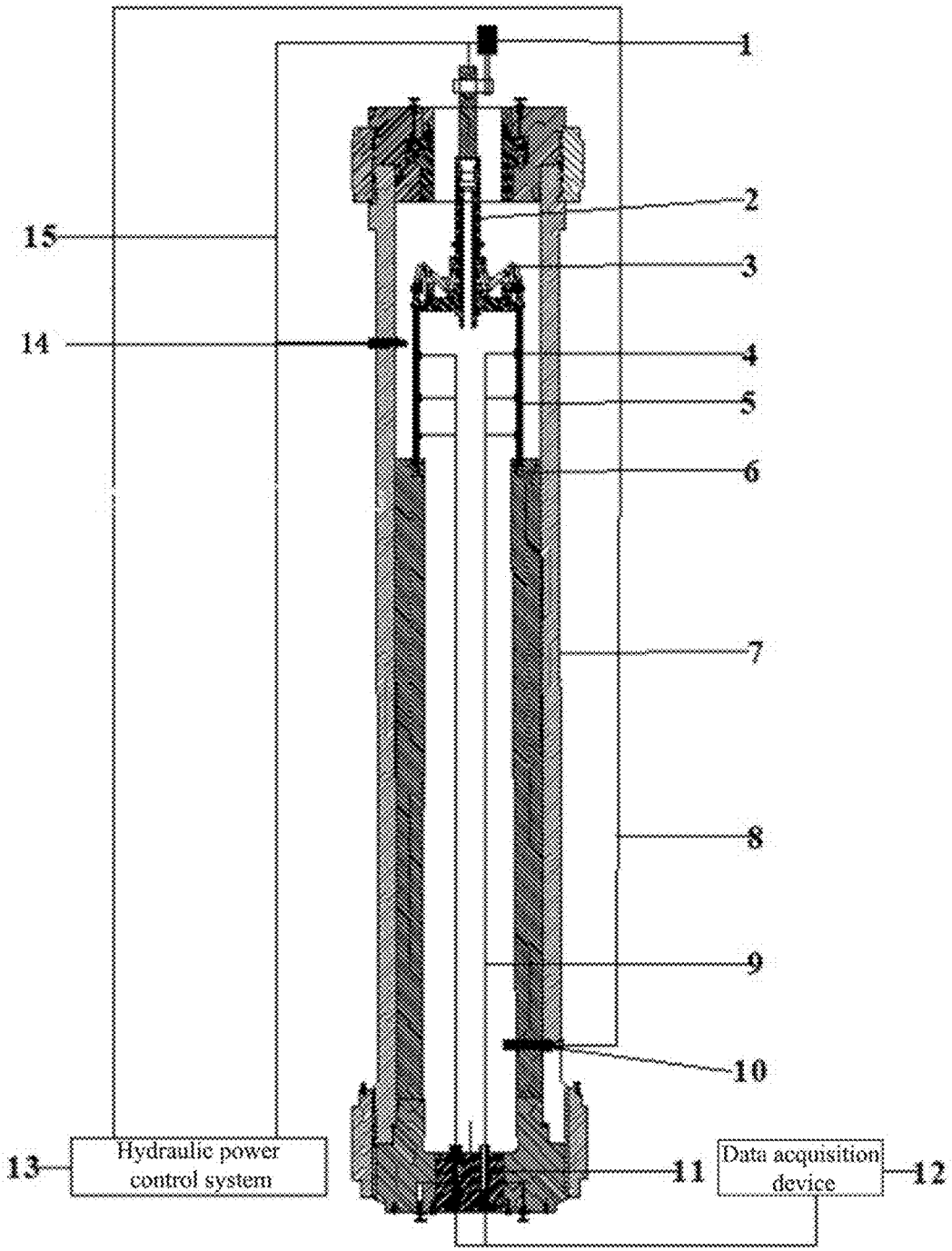
FIG. 2 is a structural schematic diagram of an underwater-wellhead feeding tool assembly according to an embodiment of the present application.

A first aspect of an embodiment of the present application provides an underwater-wellhead feeding tool assembly, as shown in FIG. 2, which includes a fix component, a drive system, and a transmission system. The fix component includes a pressure-bearing cylinder 7, and a drive cylinder 5 and an underwater-wellhead feeding tool 2 that are disposed within the pressure-bearing cylinder 7. A transmission mechanism is connected between the drive cylinder 5 and the underwater-wellhead feeding tool 2; a side wall of the pressure-bearing cylinder 7 is provided with a first port and a second port 14, and a bottom of the pressure-bearing cylinder 7 is provided with a third port 11.

The drive system includes a controller, a drive device, a first pipeline 8, and a second pipeline 15. The drive device is connected to the underwater-wellhead feeding tool 2; one end of the first pipeline 8 and one end of the second pipeline 15 are in signal connection with the controller, respectively. The signal connection includes line connection for the transmission of an electrical signal. The other end of the first pipeline 8 is connected to the first port, and the other end of the second pipeline 15 includes a first branch line, a second branch line, and a third branch line; the first branch line is connected to the second port 14, the second branch line is connected to the underwater-wellhead feeding tool 2, and the third branch line is connected to the drive device.

The transmission system includes a sensing component, a test lead 9, and a data acquisition device 12. The sensing component is provided inside the drive cylinder 5, one end of the test lead 9 is connected to the sensing component and the other end of the test lead 9 passes through the third port 11 and is connected to the data acquisition device 12.

The controller adds pressure to an inside of the drive cylinder 5 through the first pipeline 8 via the first port, and adds pressure to a cavity space between the pressure-bearing cylinder 7 and the drive cylinder 5 through the first branch line, so as to simulate an underwater pressure environment for the underwater-wellhead feeding tool 2. The controller controls, through the third branch line, the drive device to transmit a torque to the underwater-wellhead feeding tool, and transmits, through the second branch line, an axial force to the underwater-wellhead feeding tool 2, so as to simulate a force bearing situation of the underwater-wellhead feeding tool 2 during a process of connecting the underwater-wellhead feeding tool 2 to an underwater wellhead, and locking the underwater-wellhead feeding tool 2 to the underwater wellhead by a linear movement of the underwater-wellhead feeding tool 2 relative to the drive cylinder 5 by means of the transmission mechanism, and then the sensing component transmits a detected stress signal and/or strain signal to the data acquisition device 12 through test lead 9.

For the underwater-wellhead feeding tool assembly, the controller controls a plurality of pipelines to apply an axial force and torque to the underwater-wellhead feeding tool 2 in the pressure-bearing cylinder 7, so as to simulate a force bearing and deformation law of the underwater-wellhead feeding tool with respect to the process of installing an underwater wellhead when the underwater-wellhead feeding tool performs underwater operation, thereby providing theoretical guidance and basis for efficient and stable installation of underwater wellheads for oil and gas exploitation.

Preferably, the underwater-wellhead feeding tool assembly further includes an elastic member provided within the pressure-bearing cylinder 7, and elastic member is connected to the underwater-wellhead feeding tool 2 through the drive cylinder 5. In this way, during mechanical testing, when the underwater-wellhead tool 2 is applied with a test axial force, the elastic member can play a buffering role between an inner wall of the pressure-bearing cylinder 7 and the underwater-wellhead feeding tool 2 as well as the drive cylinder 5, so as to avoid collision between the underwater-wellhead feeding tool 2 and/or drive cylinder 5 and the inner wall of pressure-bearing cylinder 7 when there is mechanical overloading, and to avoid damage of the device.

Furthermore, the elastic member is a spring 6, as shown in FIG. 2. Each of two sides of the pressure-bearing cylinder 7 is provided with the spring 6, thereby further enhancing the axial buffering effect of the spring on the underwater-wellhead feeding tool 2 and drive cylinder 5.

In some possible implementations, the sensing component is a stress sensor 4 and/or strain sensor, one side or two sides of an inner wall of the drive cylinder 5 is provided with the stress sensor 4 and/or strain sensor. It can be understood by persons of ordinary skill in the art that when mechanical testing on the underwater-wellhead feeding tool 2 is performed using the present application, a stress parameter is used as a preset parameter, that is, an axial force and/or torque is applied to the underwater-wellhead feeding tool 2, a stress parameter and/or strain parameter is outputted through the stress sensor 4 and/or strain sensor, a Mises stress at a tested part of the underwater-wellhead feeding tool 2 is calculated based on Fourth Strength Theory, then the Mises stress is compared with a yield strength of a material of the tested part of the underwater-wellhead feeding tool 2, and a verification that whether plastic deformation occurs at the tested part is achieved.

Furthermore, a plurality of stress sensors 4 and/or strain sensors are provided; one end of the test lead 9 has a plurality of branch lines, the plurality of branch lines are in one-to-one connection with the plurality of stress sensors 4 and/or strain sensors. As an example, in combination with FIG. 2, six stress sensors 4 are disposed spaced on both sides of the inner wall of the driving cylinder 5, and three stress sensors 4 are disposed on each side, this arrangement can improve transmission accuracy of stress and/or strain generated after the underwater-wellhead feeding tool 2 is loaded, and reduce testing errors.

Furthermore, each stress sensor 4 and/or strain sensor is a fiber optic grating sensor, which is more sensitive and accurate than general sensors. In a possible implementation, the stress sensor 4 and/or strain sensor is a stress section and/or strain section, which is small in size and easy to install.

In a possible implementation, the transmission mechanism is a connection rod 3, and the connection rod enhances transmission efficiency and further provides better structural support for the underwater-wellhead feeding tool 2. The controller is a hydraulic power control system 13, which provides a hydraulic pressure to the underwater-wellhead feeding tool 2, and meets power conditions for performing underwater drilling operation. The drive device is a servo motor 1, which is easy to obtain and has high power efficiency, and can stably provide a testing torque to the underwater-wellhead feeding tool 2. The data acquisition system is a fiber optic stress-strain meter with a wide measurement range, high spatial resolution, and high strain measurement accuracy.

In a second aspect, an embodiment of the present application provides a use method of the underwater-wellhead feeding tool assembly mentioned in any one of the above technical solutions, which includes the following steps:

adding, by the controller, pressure to an inside of the drive cylinder 5 and to a cavity space between the pressure-cylinder 7 and the drive cylinder 5, so as to simulate a pressure environment for the underwater-wellhead feeding tool 2 to perform underwater operation; in combination with FIG. 2, that is, the drive cylinder 5 in which the underwater-wellhead feeding tool 2 is placed is disposed in the pressure-bearing cylinder 7 in advance, so that an avoidance space between the drive cylinder 5 and the pressure-bearing cylinder 7 is formed as an external cavity that is full of pressure and can be used to simulate an underwater high-pressure environment for the drive cylinder 5 and the underwater-wellhead feeding tool 2, and the inside, full of pressure, of the drive cylinder 5 can be used to well simulate a pressure environment where the underwater-wellhead feeding tool 2 linearly moves relative to the drive cylinder 5 to perform the installation operation of an underwater wellhead;

applying an axial force and/or a torque to the underwater-wellhead feeding tool 2 to simulate a force bearing situation of the underwater-wellhead feeding tool in a process of feeding and installing an underwater wellhead;

collecting a mechanical parameter of a first part, the first part includes the underwater-wellhead feeding tool 2, and the mechanical parameter includes a stress value and/or a strain value;

performing parameter processing on the mechanical parameter, where the strain value is converted into the stress value according to Generalized Hooke's Law;

performing strength verification on the underwater-wellhead feeding tool 2 according to the stress value, based on Fourth Strength Theory.

Furthermore, the strength verification step for the underwater-wellhead feeding tool 2 mainly involves calculating an axial stress, a radial stress, and a circumferential stress respectively based on a testing force applied to the underwater-wellhead feeding tool 2 and a characteristic parameter of the underwater-wellhead feeding tool 2 itself, then calculating a Mises stress, and then comparing the Mises stress obtained by calculation with a yield strength of a material of the underwater-wellhead feeding tool 2, and when the Mises stress is greater than or equal to the yield strength of the material, the material yields, that is plastic deformation occurs.

It should be noted that the underwater-wellhead feeding tool 2 is in the shape of a pipe, and a calculation formula for its axial stress is:

$$\sigma_a = \frac{F}{A_o - A_i} \quad \text{(Formula 1)}$$

in Formula 1, F is an axial force applied for testing, $A_o$ is a cross-sectional area of an outer circumference of the underwater-wellhead feeding tool 2, $A_i$ is a cross-sectional area of an inner circumference of the underwater-wellhead feeding tool 2.

A calculation formula for the radial stress is:

$$\sigma_r = \frac{p_i R_i^2 - p_o R_o^2}{R_o^2 - R_i^2} - \frac{(p_i - p_o) R_i^2 R_o^2}{R_o^2 - R_i^2} \frac{1}{r^2}. \quad \text{(Formula 2)}$$

a calculation formula for the circumferential stress is:

$$\sigma_\theta = \frac{p_i R_i^2 - p_o R_o^2}{R_o^2 - R_i^2} + \frac{(p_i - p_o) R_i^2 R_o^2}{R_o^2 - R_i^2} \frac{1}{r^2} \quad \text{(Formula 3)}$$

in Formulas 2 and 3, $R_i$ is an inner radius of the underwater-wellhead feeding tool 2, $R_o$ is an outer radius of the underwater-wellhead feeding tool 2, r is a distance from a center point of a cross-section of the underwater-wellhead feeding tool 2 in a direction perpendicular to a length direction of the pipe to a center point between an inner wall of the pipe and an outer wall of the pipe, $p_i$ is an internal pressure subjected by the underwater-wellhead feeding tool 2, i.e., an internal pressure of the drive cylinder 5, $p_o$ is an external pressure subjected by the underwater-wellhead feeding tool 2, i.e., a pressure of a cavity space between the pressure-bearing cylinder 7 and the drive cylinder 5.

A calculation formula for the Mises stress is:

$$\sigma_{\theta_\varphi} = \sqrt{\sigma_r^2 + \sigma_\theta^2 + \sigma_a^2 - \sigma_r\sigma_\theta - \sigma_r\sigma_a - \sigma_\theta\sigma_a}. \quad \text{(Formula 4)}$$

Figure 1:
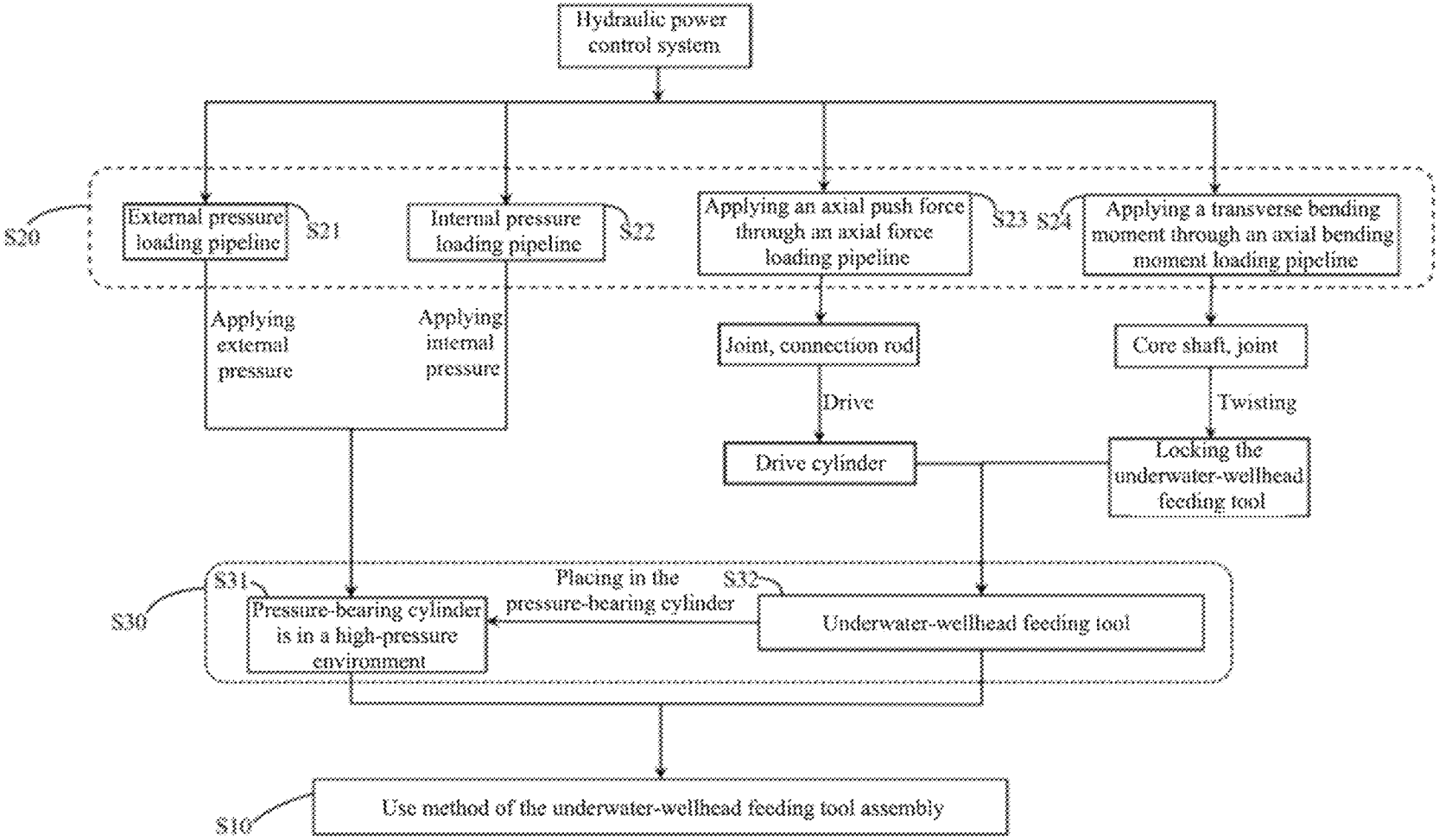
FIG. 1 is a flow schematic diagram illustrating a use method of an underwater-wellhead feeding tool assembly according to an embodiment of the present application.

In combination with FIG. 1, the above testing steps are further explained. In Step S20, the force bearing situation of the underwater-wellhead feeding tool 2 during an underwater operation is simulated by four external loading units. The power is provided by a hydraulic power control system 13. Step S21 is included in specific steps of S20, and step S21 is subjecting a first cavity between the pressure-bearing cylinder 7 and the drive cylinder 5 to be in a fully pressurized state by an external pressure loading pipeline, i.e. the provision of a hydraulic condition to the first cavity through the first branch line of the second pipeline 15; when a hydraulic pressure is loaded, selective loading can be carried out according to requirements of working conditions, and selective loading modes include the increasing of a loading force or the decreasing of the loading force, for example, the loading force can be sequentially loaded at 5 MPa, 10 MPa, 15 MPa, 20 MPa, 25 MPa, and 30 MPa.

Step S22 is included, and step S22 is transmitting, by an internal pressure loading pipeline, i.e., the first pipeline 8, the hydraulic pressure provided by the hydraulic power control system 13 to a second cavity in the inside of the drive cylinder 5 so as to apply a hydraulic condition for testing, so as to cause the second cavity to be in a fully pressurized state; when the hydraulic pressure is loaded, selective loading can be carried out according to requirements of working conditions, and selective loading modes include the increasing of a loading force or the decreasing of the loading force, for example, the loading force can be sequentially loaded at 30 MPa, 25 MPa, 20 MPa, 15 MPa, 10 MPa, and 5 MPa.

It should be noted that in steps S21 and S22, when the first cavity and/or the second cavity is applied with a pressure, a pressure test condition includes three pressurizing states that the pressure of the second cavity is higher than that of the first cavity, the pressure of the first cavity is higher than that of the second cavity, and the pressure of the first cavity is equal to that of the second cavity. These three pressurizing states can be used as the pressure test condition to test mechanical behaviors of the underwater-wellhead feeding tool 2.

Step S23 is included, and step S23 is applying an axial force to the underwater-wellhead feeding tool 2 by an axial-force loading pipeline, i.e. the second branch line of the second pipeline 15. For example, this axial force is supplied by pressurizing by a retractable piston in the servo motor 1. This hydraulic-pressure pressurizing process simulates a push force to which the underwater-wellhead feeding tool 2 is subjected when the underwater-wellhead feeding tool 2 performs underwater operation. The underwater-wellhead feeding tool 2 includes a core shaft and a joint sleeved on a periphery of the core shaft. When hydraulic pressure is applied to the joint, the joint can be pushed to move, so as to pull the connection rod 3, resulting in that the connection rod 3 is in an extended state, thus the drive cylinder 5 connected to the connection rod 3 is pushed. Therefore, a process of locking an underwater wellhead and a tube that is preset at a drilling position by means of the underwater-wellhead sending tool 2 can be simulated and tested.

It should be noted that during the underwater operation process of the underwater-wellhead feeding tool 2 equipped with an underwater wellhead, the underwater wellhead is provided with a locking part that matches with a tube that is preset at a drilling position. By applying the axial force to the underwater-wellhead feeding tool 2 to cause it to move linearly relative to the drive cylinder 5, the locking of the underwater wellhead and the tube is completed.

In a possible implementation, the hydraulic pressure transmitted by the second branch line of the second pipeline 15, which is also an axial force to which a pressure-bearing part is subjected, can be used to simulate pressure-bearing capacity of the connection rod 3, and the magnitude of the applied hydraulic pressure can be determined based on actual working conditions and research needs. In this embodiment, the first part applied with hydraulic pressure is the connection rod 3 and the joint, and the fatigue strength and stress deformation law of the connection rod 3 and the joint can be researched, where the magnitude of the applied axial force is greater than or equal to 5 MPa.

Step S24 is included, and step S24 is applying a torque to the underwater-wellhead feeding tool 2 by a transverse bending-moment loading pipeline, i.e. the third branch line of the second pipeline 15. Furthermore, the torque is loaded to the underwater-wellhead feeding tool 2, thereby causing the joint to rotate and transmitting the torque to the core shaft. Therefore, by adjusting a rotation direction, the locking and separation between the underwater-wellhead feeding tool and the underwater wellhead can be achieved.

In a possible implementation, the torque can be applied to the core shaft and/or joint to assess the law of bearing forces and deformations and structural strength of the core shaft and/or joint.

Step S30 includes step S32 of placing the underwater-wellhead feeding tool 2 in the pressure-bearing cylinder 7, and step S31 of putting the pressure-bearing cylinder 7 in a high-pressure environment to simulate the underwater high-pressure environment.

The underwater-wellhead feeding tool 2 includes the core shaft and the joint sleeved at an outside of the core shaft; the first part is one or more of the core shaft, the joint, the connection rod 3, and the drive cylinder 5.

In a possible implementation, the first part is the joint and the core shaft, or the first part is the joint, the connection rod 3, and the drive cylinder 5. This allows for sufficient testing of force bearing situations and structural strength of the underwater-wellhead feeding tool 2 including the core shaft and the joint and of force bearing situations and structural strength of a mating part connected to the underwater-wellhead feeding tool 2, when the underwater-wellhead feeding tool 2 works.

In a possible implementation, parts to which the axial force is applied are the joint, the connection rod 3, and drive cylinder 5, and for the entirety of the three, the situation of getting into the water and the behavior of locking to the tube can be studied, and force bearing situations and structural strength of the joint and connection rod 3 can be tested.

The use method includes performing a separate test or a combination test on the first part; where the separate test is applying an axial force or a torque to the first part separately for testing; and the combination test is applying the axial force and the torque to the first part for testing.

In this way, under conditions of feeding and installing an underwater wellhead for underwater drilling, not only the law of mechanical behaviors of the underwater-wellhead feeding tool 2 under a single force field can be studied in a laboratory, but also the law of influence of bearing forces on the material of the underwater-wellhead feeding tool 2 under a composite force field can be studied, so as to meet engineering applications as far as possible.

Furthermore, combination forms of the combination test include: applying a constant axial force and a variable torque to the underwater-wellhead feeding tool 2, or applying a constant torque and a variable axial force to the underwater-wellhead feeding tool 2, or applying a variable axial force and a variable torque to the underwater-wellhead feeding tool 2. By optimizing mechanical variable conditions of the underwater-wellhead feeding tool 2 in a composite force field, the force bearing situation of the underwater-wellhead feeding tool in a process of feeding and installing an underwater wellhead can be fully simulated and analyzed, thereby further strengthening the guiding role in engineering practice.

Furthermore, the combination test in different combination forms for the underwater-wellhead feeding tool 2 is performed by controlling an internal pressure, i.e. an internal pressure of the drive cylinder 5, and further controlling an external pressure, i.e. a pressure between the drive cylinder 5 and the pressure-bearing cylinder 7. For example, the combination test includes a combination form of a constant internal pressure, a variable axial force and a variable torque. The combination form can also be applying a torque force and an axial pushing force which are the same, applying a torque force and an axial pushing force where the torque force is larger than the axial pushing force, or applying an torque force and an axial pushing force where the axial pushing force is larger than the torque force. Persons of ordinary skill in the art can understand that this testing method mainly studies the influence of an axial force or torque on mechanical behaviors of the underwater-wellhead feeding tool 2 under the same pressure environment.

In other possible embodiments, the combination test includes a combination form of an axial force and a torque that are controlled to be constant, an internal pressure, and an external pressure as research variants. The research conditions include that the internal pressure is the same as the external pressure, the internal pressure is greater than the external pressure, and the internal pressure is less than the external pressure. This test method is used to study the influence of a pressure environment on the force bearing situation and structural strength of the first part of the underwater-wellhead feeding tool 2 under the condition of the axial force and torque which are the same.

As a possible implementation, the combination test may involve studying of the influence of different axial forces on mechanical behaviors of the first part of the underwater-wellhead feeding tool 2 when a torque and an environmental pressure including an internal pressure and an external pressure are controlled to be constant. This test method mainly studies, when the torque, internal and external pressures are not main factors, the influence of the axial force used as a main influencing factor on the force bearing situation and structural strength of the first part of the underwater-wellhead feeding tool 2.

As another possible implementation, the combination test involves studying of the influence of different torques on mechanical behaviors of the first part of the underwater-wellhead feeding tool 2 when an axial force and an environmental pressure including an internal pressure and an external pressure are controlled to be constant. This test method mainly studies, when the axial force, internal and external pressures are not main factors, the influence of the torque used as a main influencing factor on the force bearing situation and structural strength of the first part of the underwater-wellhead feeding tool 2.

In another example, the combination test involves studying of the influence of multiple factors such as a torque, an internal pressure, and an external pressure on mechanical behaviors of the first part of the underwater-wellhead feeding tool 2 when an axial force applied to the first part of the underwater-wellhead feeding tool 2 is controlled to be constant. Where, the form of changing internal and external pressures in the combination test includes three forms for the combination test, which are that the internal pressure is equal to the external pressure, the internal pressure is higher than the external pressure, and the external pressure is higher than the internal pressure.

In another example, the combination test involves studying of the influence of multiple factors such as an axial force, an internal pressure, and an external pressure on mechanical behaviors of the first part of the underwater-wellhead feeding tool 2 when a torque applied to the first part of the underwater-wellhead tool 2 is controlled to be constant. Where, the form of changing internal and external pressures in the combination test includes three forms for the combination test, which are that the internal pressure is equal to the external pressure, the internal pressure is higher than the external pressure, and the external pressure is higher than the internal pressure.

In the description of the present application, it should be understood that only for ease of describing the present application and simplifying the description, orientations or positional relationships indicated with the terms "up", "down", "front", "back", "left", "right", "vertical", "horizontal", "top", "bottom", "inside", "outside", and the like are orientations or positional relationships based on the orientations or positional relationships shown in the accompanying drawings, these orientations or positional relationships do not indicate or imply that the device or component referred to must has a specific orientation, be constructed and operated in a specific orientation, therefore these orientations or positional relationships cannot be understood as a limitation to the present application.

In addition, terms "first" and "second" are only used for descriptive purpose and cannot be understood as indicating or implying relative importance or implying the number of technical features referred to. Therefore, features defined with "first" and "second" can explicitly or implicitly include at least one of the features. In the description of the present application, "a plurality of" means at least two, such as two, three, etc., unless otherwise specifically defined.

In the present application, unless otherwise specified and limited, terms "installation", "connected to", "connected with", "fixation" and other terms should be broadly understood, for example, the connection can be a fixed connection, a detachable connection, or an integrated connection; the connection can be a mechanical connection or an electrical connection; the connection can be a directly connection or an indirectly connection through an intermediate medium; the connection can be an internal communication between two components or an interaction relationship between two components, unless otherwise specified. For persons of ordinary skill in the art, the specific meanings of the above terms in the present application can be understood based on specific circumstances.

In the present application, unless otherwise specified and limited, a case in which a first feature is "above" or "below" a second feature may be that the first feature is in direct contact with the second feature, or the first feature and the second feature are in indirect contact through an intermediate media. Moreover, a case in which a first feature is "above", "over", or "on top of" a second feature may be that the first feature is directly or diagonally above the second feature, or simply indicates that the first feature is horizontally higher than the second feature. A case in which a first feature is "below", "under", or "underneath" a second feature can indicate that the first feature is directly or diagonally below the second feature, or simply indicates that the first feature is horizontally lower than the second feature.

Respective embodiments or implementations in the specification are described in a progressive manner, and each embodiment focuses on the differences from other embodiments. The same and similar parts between respective embodiments can be referred to each other.

It should be noted that embodiments, indicated with "one embodiment", "embodiments", "exemplary embodiment", "some embodiments", etc., referred to in the specification, may include specific features, structures, or characteristics, but it is not necessarily that every embodiment includes that specific features, structures, or characteristics. Furthermore, such phrases may not necessarily refer to the same embodiment. In addition, when describing specific features, structures, or characteristics in combination with embodiments, a case in which such features, structures, or characteristics are achieved in combination with other embodiments that are clearly or not clearly described falls into the knowledge scope of persons of ordinary skill in the art.

Finally, it should be noted that the foregoing embodiments are merely intended for describing the technical solutions of the present application other than limiting the present application. Although the present application is described in detail with reference to the foregoing embodiments, persons of ordinary skill in the art should understand that they may still make modifications to the technical solutions described in the foregoing embodiments or make equivalent substitutions to some or all technical features thereof, without making the essence of the corresponding technical solutions depart from the scope of the technical solutions of various embodiments of the present application.

What is claimed is:

1. An underwater-wellhead feeding tool assembly, comprising a fix component, a drive system, and a transmission system; wherein the fix component comprises a pressure-bearing cylinder, and a drive cylinder and an underwater-wellhead feeding tool that are disposed within the pressure-bearing cylinder; wherein a transmission mechanism is connected between the drive cylinder and the underwater-wellhead feeding tool; a side wall of the pressure-bearing cylinder is provided with a first port and a second port, and a bottom of the pressure-bearing cylinder is provided with a third port;

the drive system comprises a controller, a drive device, a first pipeline, and a second pipeline; the drive device is connected to the underwater-wellhead feeding tool, one end of the first pipeline and one end of the second pipeline are in signal connection with the controller, respectively; the other end of the first pipeline is connected to the first port, the other end of the second pipeline comprises a first branch line, a second branch line, and a third branch line; the first branch line is connected to the second port, the second branch line is connected to the underwater-wellhead feeding tool, and the third branch line is connected to the drive device;

the transmission system comprises a sensing component, a test lead, and a data acquisition device; the sensing component is provided inside the drive cylinder; one end of the test lead is connected to the sensing component, and the other end of the test lead passes through the third port and is connected to the data acquisition device;

the controller adds pressure to an inside of the drive cylinder through the first pipeline via the first port, and adds pressure to a cavity space between the pressure-bearing cylinder and the drive cylinder through the first branch line, so as to simulate an underwater pressure environment for the underwater-wellhead feeding tool; the controller controls, through the third branch line, the drive device to transmit a torque to the underwater-wellhead feeding tool, and transmits, through the second branch line, an axial force to the underwater-wellhead tool, so as to simulate a force bearing situation of a process of connecting the underwater-wellhead feeding tool to an underwater wellhead, and locking the underwater-wellhead feeding tool to the underwater wellhead by a linear movement of the underwater-wellhead feeding tool relative to the drive cylinder by means of the transmission mechanism, and then the sensing component transmits a detected stress signal and/or strain signal to the data acquisition device through the test lead.

2. The underwater-wellhead feeding tool assembly according to claim 1, wherein the underwater-wellhead feeding tool assembly further comprises an elastic member provided within the pressure-bearing cylinder, the elastic member is connected to the underwater-wellhead feeding tool through the drive cylinder; and the elastic member is a spring.

3. The underwater-wellhead feeding tool assembly according to claim 1, wherein the sensing component is a stress sensor and/or strain sensor, and one side or two sides of an inner wall of the drive cylinder is provided with the stress sensor and/or strain sensor.

4. The underwater-wellhead feeding tool assembly according to claim 3, wherein a plurality of stress sensors and/or strain sensors are provided, one end of the test lead has a plurality of branch lines, and the plurality of branch lines are in one-to-one connection with the plurality of stress sensors and/or strain sensors; each stress sensor and/or strain sensor is a fiber optic grating sensor.

5. The underwater-wellhead feeding tool assembly according to claim 1, wherein the transmission mechanism is a connection rod; the controller is a hydraulic power control system; the drive device is a servo motor; and the data acquisition system is a fiber optic stress-strain meter.

6. The underwater-wellhead feeding tool assembly according to claim 2, wherein the transmission mechanism is a connection rod; the controller is a hydraulic power control system; the drive device is a servo motor; and the data acquisition system is a fiber optic stress-strain meter.

7. The underwater-wellhead feeding tool assembly according to claim 3, wherein the transmission mechanism is a connection rod; the controller is a hydraulic power control system; the drive device is a servo motor; and the data acquisition system is a fiber optic stress-strain meter.

8. The underwater-wellhead feeding tool assembly according to claim 4, wherein the transmission mechanism is a connection rod; the controller is a hydraulic power control system; the drive device is a servo motor; and the data acquisition system is a fiber optic stress-strain meter.

9. A use method of the underwater-wellhead feeding tool assembly according to claim 1, comprising the following steps:

adding, by the controller, pressure to an inside of the drive cylinder and to a cavity space between the pressure-bearing cylinder and the drive cylinder, so as to simulate a pressure environment for the underwater-wellhead feeding tool to perform underwater operation;

applying an axial force and/or a torque to the underwater-wellhead feeding tool, to simulate a force bearing situation of the underwater-wellhead feeding tool in a process of feeding and installing an underwater wellhead;

collecting a mechanical parameter of a first part, the first part comprises the underwater-wellhead feeding tool; and the mechanical parameter comprises a stress value and/or a strain value;

performing parameter processing on the mechanical parameter, wherein the strain value is converted into the stress value according to Generalized Hooke's Law;

performing strength verification on the underwater-wellhead feeding tool according to the stress value, based on Fourth Strength Theory.

10. The use method according to claim 9, wherein a connection rod is connected between the underwater-wellhead feeding tool and the drive cylinder, and the underwater-wellhead feeding tool comprises a core shaft and a joint sleeved at an outside of the core shaft;

the first part is one or more of the core shaft, the joint, the connection rod, and the drive cylinder.

11. The use method according to claim 9, wherein the use method involves performing a separate test or a combination test on the first part; the separate test involves applying the axial force or the torque to the first part separately for testing; the combination test involves applying the axial force and the torque to the first part for testing.

12. The use method according to claim 11, wherein combination forms of the combination test comprise: applying a constant axial force or a variable torque to the underwater-wellhead feeding tool, or applying a constant torque or a variable axial force to the underwater-wellhead feeding tool, or applying a variable axial force and a variable torque to the underwater-wellhead feeding tool.

13. The use method according to claim 9, wherein the strength verification comprises the following steps:

calculating an axial stress, a radial stress, and a circumferential stress, to which the underwater-wellhead feeding tool is subjected, the underwater wellhead feeding tool is in the shape of a pipe;

calculating a Mises stress based on the axial stress, the radial stress, and the circumferential stress;

comparing the Mises stress with a yield strength of a material of the underwater-wellhead feeding tool;

wherein, a calculation formula for the axial stress is:

$$\sigma_a = \frac{F}{A_o - A_i} \quad \text{(Formula 1)}$$

in Formula 1, F is an axial force applied for testing, $A_0$ is a cross-sectional area of an outer circumference of the underwater-wellhead feeding tool, $A_i$ is a cross-sectional area of an inner circumference of the underwater-wellhead feeding tool;

a calculation formula for the radial stress is:

$$\sigma_r = \frac{p_i R_i^2 - p_o R_o^2}{R_o^2 - R_i^2} - \frac{(p_i - p_o) R_i^2 R_o^2}{R_o^2 - R_i^2} \frac{1}{r^2} \quad \text{(Formula 2)}$$

a calculation formula for the circumferential stress is:

$$\sigma_\theta = \frac{p_i R_i^2 - p_o R_o^2}{R_o^2 - R_i^2} + \frac{(p_i - p_o) R_i^2 R_o^2}{R_o^2 - R_i^2} \frac{1}{r^2} \quad \text{(Formula 3)}$$

in Formulas 2 and 3, $R_i$ is an inner radius of the underwater-wellhead feeding tool, $R_o$ is an outer radius of the underwater-wellhead feeding tool, r is a distance from a center point of a cross-section of the underwater-wellhead feeding tool in a direction perpendicular to a length direction of the pipe to a center point between an inner wall of the pipe and an outer wall of the pipe, $p_i$ is an internal pressure subjected by the underwater-wellhead feeding tool, i.e., an internal pressure of the drive cylinder, $p_o$ is an external pressure subjected by the underwater-wellhead feeding tool, i.e., a pressure of a cavity space between the pressure-bearing cylinder and the drive cylinder;

a calculation formula for the Mises stress is:

$$\sigma_{\theta\varphi} = \sqrt{\sigma_r^2 + \sigma_\theta^2 + \sigma_a^2 - \sigma_r\sigma_\theta - \sigma_r\sigma_a - \sigma_\theta\sigma_a}. \quad \text{(Formula 4)}$$

* * * * *